United States Patent [19]

Overstreet

[11] Patent Number: 4,907,140

[45] Date of Patent: Mar. 6, 1990

[54] COLLAPSIBLE LANTERN

[75] Inventor: William R. Overstreet, Richmond, Va.

[73] Assignee: The CandleGlo Corp., Paramus, N.J.

[21] Appl. No.: 401,078

[22] Filed: Aug. 31, 1989

[51] Int. Cl.[4] ..... F21L 19/00

[52] U.S. Cl. ..... 362/162; 229/155; 229/162; 229/185

[58] Field of Search ..... 362/162; 229/155, 162, 229/185

[56] References Cited

U.S. PATENT DOCUMENTS

| | | | |
|---|---|---|---|
| 1,236,334 | 8/1917 | Mayo | 362/161 |
| 1,953,885 | 4/1934 | McAleer | 229/185 |
| 1,988,765 | 1/1935 | Wolf | 362/162 |
| 2,269,013 | 1/1942 | Dorfman | 229/185 X |
| 4,163,333 | 8/1979 | Kwiatkowski | 362/161 X |

FOREIGN PATENT DOCUMENTS

| | | | |
|---|---|---|---|
| 32419 | 8/1885 | Fed. Rep. of Germany | 362/162 |
| 21071 | 4/1898 | Fed. Rep. of Germany | 362/162 |

*Primary Examiner*—Allen M. Ostrager
*Attorney, Agent, or Firm*—Anthony F. Cuoco

[57] ABSTRACT

A collapsible lantern is disclosed which is formed from a blank which is stamped or otherwise provided from a suitable paperboard material. The lantern blank has four panels which are folded and two of the panels are secured together to form a four sided member. The member carries flaps which are engageable to provide a closed bottom and an open gable top for the lantern, and whereby the lantern is substantially rectangular in cross-section. The arrangement is such that a candle or like light source is disposed within the lantern and at the closed bottom thereof. Holes are provided on the lantern sides and light from the candle is emitted through the holes and through the open gable top to provide the desired result. The flaps are disengageable whereby the lantern is collapsible to a flat form for easy shipment and storage, as the case may be.

11 Claims, 3 Drawing Sheets

COLLAPSIBLE LANTERN

BACKGROUND OF THE INVENTION

This invention relates generally to lanterns of the type used for decorating purposes, and particularly to lanterns using candles or the like as a light source. More particularly, this invention relates to collapsible lanterns of the type described.

An increasingly popular way of decorating exterior areas during holiday seasons, or for parties or like festive occasions, is with lanterns using candles or the like as a light source. These lanterns are commonly used, for example, to outline paths, swimming pool areas, garden areas, house exteriors, and other like areas.

The present invention provides a lantern for the purposes described which is of a paper material so as to be easy to manufacture, and which is collapsible to a flat form for ease in shipment and storage, as well as configurable to permit fast and easy assembly from the flat form.

The applicant is aware of the following prior art searched in Class 362, Subclass 162 and in Class 431, Subclass 289 which relates generally to lanterns or candle holders or the like.

U.S. Pat. No. 47,733 issued to Kassebaum on May 16, 1865 relates to a collapsible portable lantern featuring a wire-like frame and handle.

U.S. Pat. No. 121,923 issued to Wright on Dec. 12, 1871 relates to a lantern or the like in the form of a collapsible wire frame, which supports transparencies on its sides.

U.S. Pat. No. 277,712 issued to Grumbach on May 15, 1883 relates to a paper lantern having a series of ribs loosely connected at their ends and capable of folding or swinging together, combined with a string passing through holes in two adjacent ribs and through the upper end of another rib for pulling the bottom and top of the lantern together.

U.S. Pat. No. 611,898 issued to Eastman on Oct. 4, 1889 relates specifically to a lantern or candle holder used in photographic darkrooms. The candle holder is formed of paper and is at least partially collapsible.

U.S. Design Pat. No. 16,390 issued to Franke on May 15, 1985 relates to a paper lantern with a configuration having a bottom and four sides for supporting a candle.

U.S. Pat. No. 4,544,351 issued to Marsicano on Oct. 1, 1985 relates to a candle holder formed of paper or plastic which is inserted into a glass or other like article for supporting a candle therein.

It is evident that the aforenoted prior art does not teach the particular structural configuration as herein disclosed and as will hereinafter be described, nor do the prior art devices satisfy the aforenoted purposes and advantages of the present invention.

SUMMARY OF THE INVENTION

This invention contemplates a collapsible lantern featuring a blank which is stamped or otherwise formed from a suitable paperboard to provide four panels having common creased sides, whereby the blank is folded along the creased sides and joined at its end panels to form a four sided member. The ends of the panels terminate in creased flaps. The flaps are folded along their creases to engage and disengage, whereby the bottom of the four sided member is closed and the top of the member is formed in an open gable configuration when the flaps engage. The panels of the four sided member carry a plurality of holes in a predetermined pattern whereby a decorative lantern is provided which is collapsible to a flat form upon disengagement of the flaps so as to facilitate shipment and storage and the like. A candle or other like light source is disposed within the lantern at the closed bottom thereof, and light from the light source shines through the holes and the open gable top for the purposes intended.

DETAILED DESCRIPTION OF THE INVENTION

Figure 1:
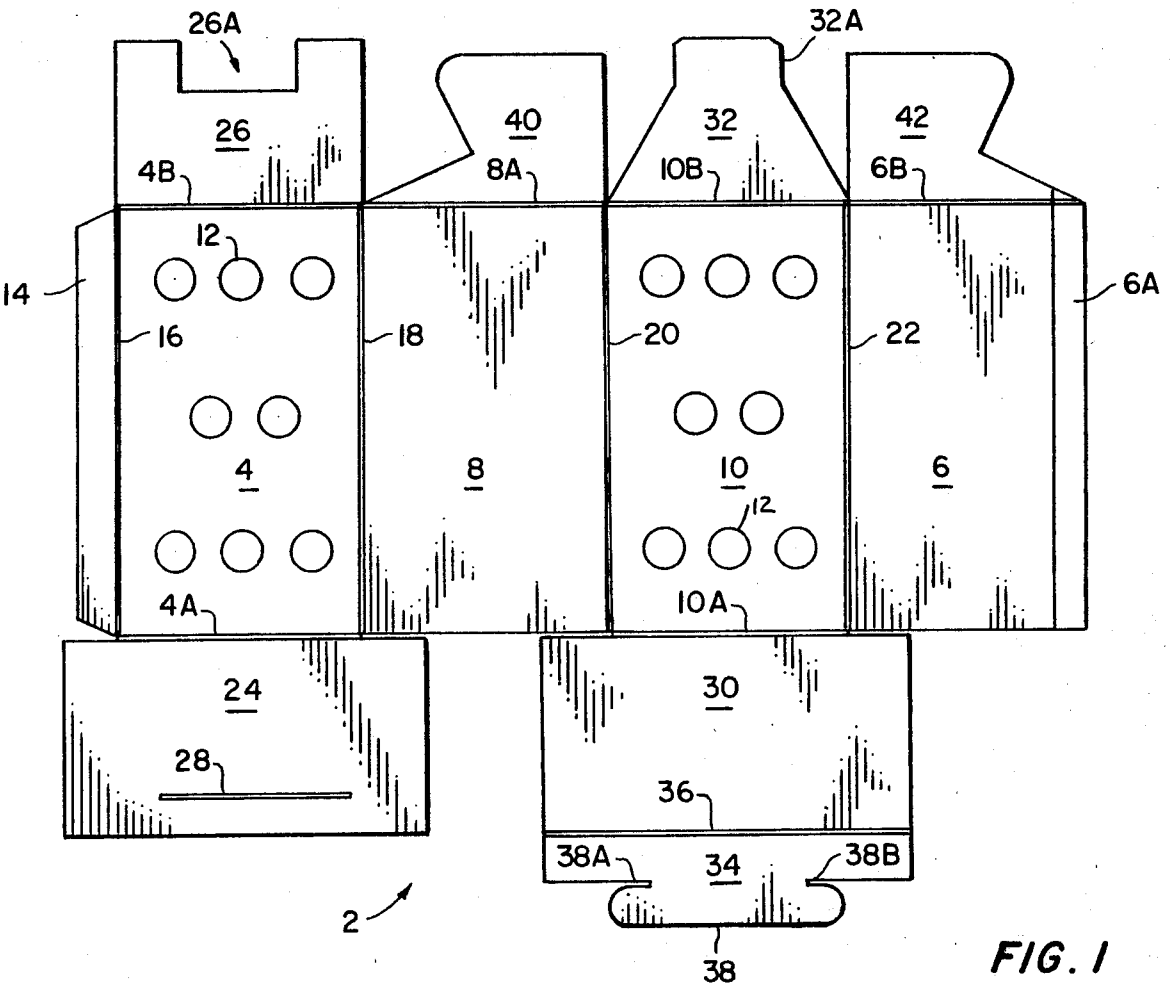
FIG. 1 is a plan view illustrating a lantern blank according to the invention.

With reference first to FIG. 1, a lantern blank is designated generally by the numeral 2. Lantern blank 2 is stamped or otherwise formed from a solid bleached sulfate grade of paperboard having a clay coating and a plastic overcoat of a suitable polymer or the like and being approximately 0.029 inches thick.

Blank 2 has a pair of end panels 4 and 6 and a pair of center panels 8 and 10. Panels 4 and 10 carry a plurality of through holes 12 in a predetermined pattern for purposes which will be hereinafter explained.

Panel 4 carries a securing tab designated by the numeral 14. Tab 14 is used in forming a substantially rectangular member as will be hereinafter described.

Figure 2:
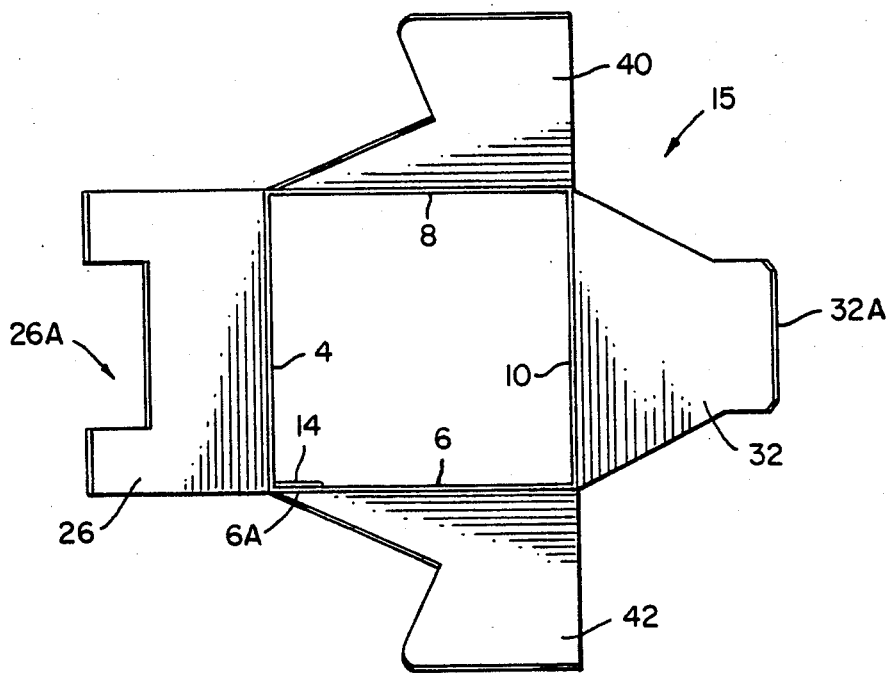
FIG. 2 is a bottom view showing a four sided member according to the invention with tabs at the ends of the panels thereof disengaged.
Figure 3:
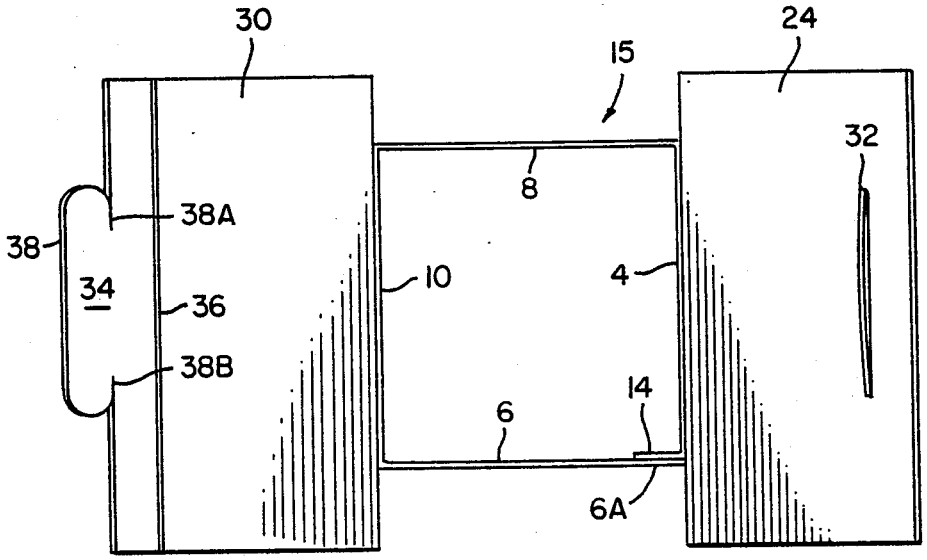
FIG. 3 is a top view showing the four sided member with tabs at opposite ends of the panels thereof disengaged.
Figure 8:
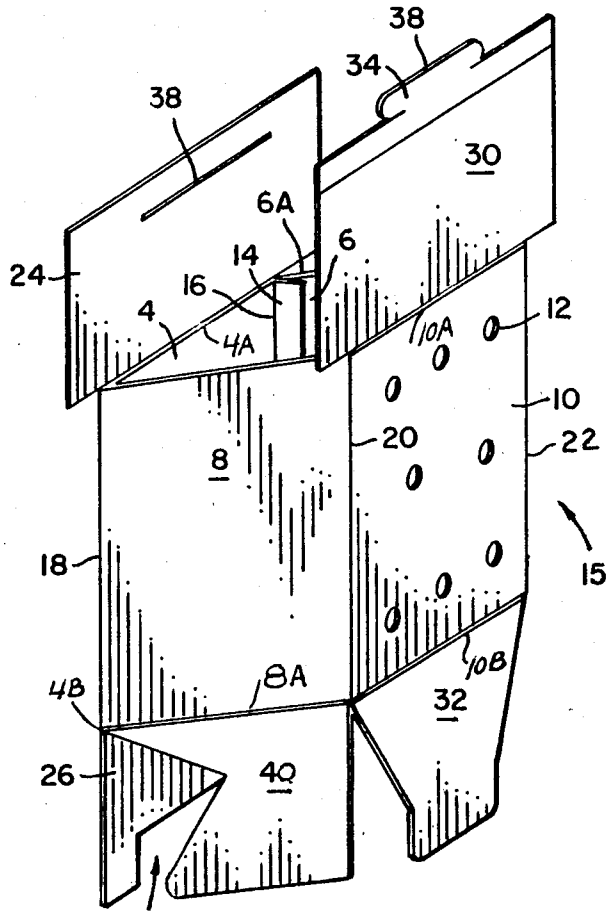
FIG. 8 is a pictorial representation showing the four sided member with the panels thereof disengaged.

Tab 14 and panel 4 have a common creased side 16; panel 4 and panel 8 have a common creased side 18; panel 8 and panel 10 have a common creased side 20; and panel 10 and panel 6 have a common creased side 22. Panels 4, 8, 10 and 6 are folded inwardly along their respective creased sides 18, 20 and 22 and tab 14 is folded inwardly along creased side 16 so that a four sided member 15 is formed when tab 14 is secured as by cementing or the like to a side 6A of panel 6, as more specifically shown in FIGS. 2, 3 and 8.

A flap 24 extends from an end 4A of panel 4 and a flap 26 extends from an opposite end 4B of panel 4. Ends 4A and 4B are creased so that flaps 24 and 26 are foldable relative to panel 4. Flap 24 carries a discretely located slot 28. Flap 24 extends beyond creased sides 16 and 18, but is detached therefrom as shown in FIG. 1.

A flap 30 extends from an end 10A of panel 10 and a flap 32 extends from an opposite end 10B of panel 10. Ends 10A and 10B are creased so that flaps 30 and 32 are foldable relative to panel 10. Flap 30 carries an extended portion 34, with extended portion 34 and flap 30 having a common creased edge 36 so that extended portion 34 is foldable relative to flap 30. Extended portion 34 carries a discretely disposed tab 38 which is detached at its ends 38A and 38B from extended portion 34, and which tab 38 engages slot 28 in tab 24 as will hereinafter be discerned. Flap 30 extends beyond creased sides 20 and 22, but is detached therefrom as shown in FIG. 1.

A flap 40 extends from an end 8A of panel 8 between flaps 26 and 32 and a flap 42 extends from an end 6B of panel 6 to the right of flap 32. Ends 8A and 6B are creased so that flaps 40 and 42 are foldable relative to the respective panels 8 and 6.

Flaps 26, 32, 40 and 42 are discretely shaped so as to be engageable as will be hereinafter explained.

Figure 4:
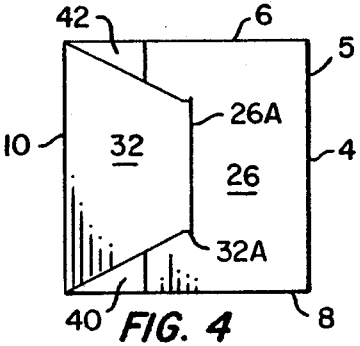
FIG. 4 is a bottom view showing the tabs shown in FIG. 2 engaged, and whereby the bottom of said member is closed.

In order to form the lantern of the invention, and with the four sided member 15 provided as just described, flaps 40 and 42 are folded inwardly so as to overlap. Flap 26 is folded inwardly so as to overlap folded flaps 40 and 42, and flap 32 is folded inwardly with portion 32A thereof inserted under notched portion 26A of flap 26. Thus, a closed lantern bottom 5 is formed as particularly shown in FIGS. 4, 6 and 7.

Figure 7:
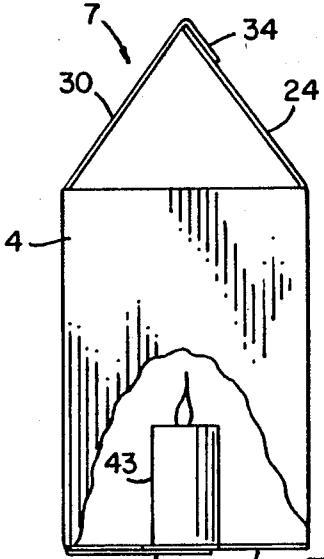
FIG. 7 is an elevational view showing another panel of the lantern of the invention and showing the open gable top configuration, and showing the panel partially cut-away to illustrate the disposition of a light source within the lantern.
Figure 5:
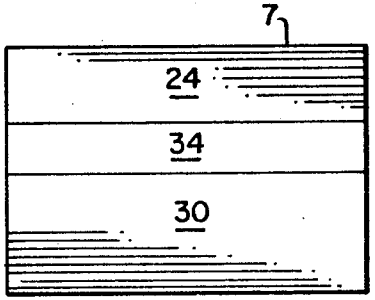
FIG. 5 is a top view showing the tabs shown in FIG. 3 engaged, and whereby the top of the member is formed in an open gable configuration.
Figure 6:
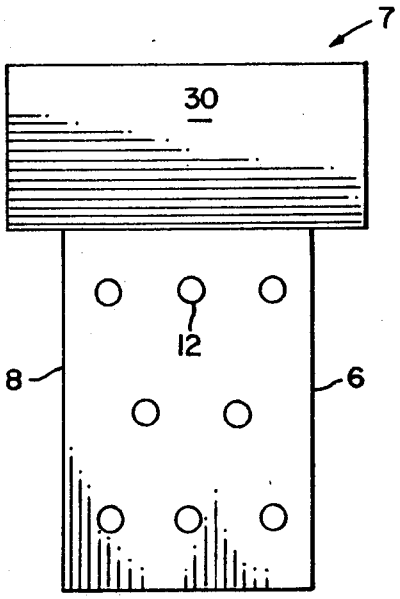
FIG. 6 is an elevational view showing one of the panels of the lantern of the invention and which panel carries holes in a predetermined pattern.

Flap 24 is folded inwardly and flap 30 is likewise folded inwardly, whereupon extended portion 34 of flap 30 is folded inwardly so that tab 38 engages slot 28 in flap 24 to thereby form an open gable lantern top 7 as particularly shown in FIGS. 5, 6 and 7.

The lantern thus formed has a substantially rectangular cross-section and a top and bottom as aforenoted. When the several flaps 24, 30 and 40, 42, 26 and 32 are disengaged the lantern is collapsible. That is to say, the lantern is outwardly foldable about creased sides 18, 20 and 22 and creased ends 4A, 4B, 6B, 8A, 10A and 10B to a flat form for ease shipment and storage, as the case may be, as will be discerned from FIG. 8.

With particular reference to FIG. 7, a candle or other like light source designated by the numeral 43 is disposed inside the lantern formed as aforenoted and at the bottom thereof. The preferred embodiment of the invention contemplates a candle of the type commonly known as a votive candle. That is to say, a candle having a relatively large diameter as compared to its length. It is contemplated that wax drippings from candle 43 will be used to secure the candle to the bottom of the lantern, the same being found to suffice for the conditions under which the lantern is to be used. In this connection it will be understood that the aforenoted material of blank 2 has been selected to withstand adverse environmental conditions under which the lantern is likely to be used.

It will be understood that the lantern formed as aforenoted can be of varying colors and can carry indicia such as seasonal greetings or the like so as to enhance its decorative characteristics. The lantern is made of a material which is resistant to various environmental conditions likely to be encountered, and in any event is economical to manufacture and hence easy to replace as the situation may require.

Holes 12 are shown on only two panels and in a particular pattern. It will be understood that the holes may be on more or less than the two panels and in a variety of patterns, as may be desired.

With the above description of the invention in mind reference is made to the claims appended hereto for a definition of the scope of the invention.

What is claimed is:

1. A collapsible lantern, comprising:

a flat blank of a foldable material, the blank having a first outside panel, a first inside panel, a second inside panel and a second outside panel;

the first outside panel and the first inside panel having a common creased side;

the first inside panel and the second inside panel having a common creased side;

the second inside panel and the second outside panel having a common creased side;

a side tab extending from the first outside panel on the side thereof opposite the common creased side of said panel and the first inside panel, and having a creased side common with the opposite side of the first outside panel;

the second outside panel having a securing side opposite the common creased side of said panel and the second inside panel;

a first flap extending from one end of the blank and having a creased end common with the corresponding end of the first outside panel;

a second flap extending from the one end of the blank and having a creased end common with the corresponding end of the first inside panel;

a third flap extending from the one end of the blank and having a creased end common with the corresponding end of the second inside panel;

a fourth flap extending from the one end of the blank and having a creased end common with the corresponding end of the second outside panel;

a fifth flap extending from an opposite end of the blank and having a creased end common with the corresponding end of the first outside panel;

a sixth flap extending from the opposite end of the second inside panel and having a creased end common with the corresponding end of the second inside panel;

the blank inwardly folded about its creased sides and the side tab extending from the first outside panel secured to the securing side of the second outside panel whereby a four sided member is provided;

the first, second, third and fourth flaps being engageable and disengageable and inwardly folded about their creased ends to engage and to form a closed bottom for the four sided member;

the fifth and sixth flaps being engageable and disengageable and inwardly folded about their creased ends to engage and to form a top for the four sided member;

a light source disposed within the four sided member on the closed bottom thereof;

the sides of the four sided member having a plurality of holes in a predetermined pattern;

light from the light source being emitted from the inside of the four sided member through the plurality of holes; and the first, second, third, fourth, fifth and sixth flaps being disengaged and being outwardly folded about their creased ends, whereby the four sided member is collapsible to a flat form when the light source is removed from within the member.

2. A collapsible lantern as described by claim 1, wherein:

the fifth and sixth flaps are inwardly folded about their creased ends to engage and to form a gable top for the four sided member.

3. A collapsible lantern as described by claim 2, wherein:

the gable top of the four sided member is open; and light from the light source is emitted from the inside of the four sided member through the open gable top and through the plurality of holes.

4. A collapsible lantern as described by claim 2, including:

the fifth flap having a discretely disposed slot therein;

the sixth flap terminating in a seventh flap and said sixth and seventh flaps having a common creased end;

the end of the seventh flap opposite the common creased end having a correspondingly discretely disposed tab; and the fifth, sixth and seventh flaps being inwardly folded about their creased ends and the discretely disposed tab on the end of the seventh flap being disposed over the fifth flap and engaging the discretely disposed slot therein to provide the gable top.

5. A collapsible lantern as described by claim 3, including:

the fifth flap having a discretely disposed slot therein;

the sixth flap terminating in a seventh flap and said sixth and seventh flaps having a common creased end;

the end of the seventh flap opposite the common creased end having a correspondingly discretely disposed tab; and the fifth, sixth and seventh flaps being inwardly folded about their creased ends and the discretely disposed tab on the end of the seventh flap being disposed over the fifth flap and engaging the discretely disposed slot therein to provide the open gable top.

6. A collapsible lantern as described by claim 1, wherein:

the foldable material is a solid bleached paperboard having a clay coating and a polymer overcoat, and being approximately 0.029 inches in thickness.

7. A collapsible lantern, comprising:

a flat blank of a foldable material, and folded to form four sides, with the opposite ends of the blank secured together to form a four sided member;

one end of each of the sides having a flap, said flaps being foldable for engaging and disengaging, and being folded inwardly to engage and to form a closed bottom for the member;

the opposite ends of two opposite sides having flaps, said flaps being foldable for engaging and disengaging and being folded inwardly to engage and to form a gable top for the member;

the sides of the member having a plurality of holes in a predetermined pattern;

a light source disposed within the four sided member on the closed bottom thereof;

light from the light source being emitted from the inside of the four sided member through the plurality of holes; and the flaps forming the closed bottom and the flaps forming the gable top being outwardly folded for disengaging, whereby the four sided member is collapsible to a flat form when the light source is removed from within the member.

8. A collapsible lantern as described by claim 7, wherein:

the gable top of the four sided member is open; and light from the light source being emitted from the inside of the four sided member through the open gable top and through the plurality of holes.

9. A collapsible lantern as described by claim 7, wherein:

the foldable material is a solid bleached paperboard having a clay coating and a polymer overcoat, and being approximately 0.029 inches in thickness.

10. A method for providing a collapsible lantern, comprising:

providing a flat blank of a foldable material;

folding the blank to form four sides with each of the sides having a flap at one end and two of the sides having a flap at the opposite end;

securing the ends of the blank together to provide a four sided member;

folding the flaps at the one end of the sides and engaging the folded flaps for providing a closed bottom for the member;

folding the flaps at the opposite end of the two opposite sides and engaging the folded flaps to form a gable top for the member;

providing a plurality of holes in the sides of the member;

disposing a light source within the member on the closed bottom thereof, whereby light from the light source is emitted through said holes; and disengaging the flaps forming the closed bottom and the flaps forming the gable top, and collapsing the four sided member to a flat form after removing the light source from within the member.

11. A method as described by claim 10, including:

folding the flaps at the opposite end of the two opposite sides to form an open gable top for the member; and disposing a light source within the member on the closed bottom thereof whereby light from the light source is emitted through the plurality of holes and through the open gable top.

* * * * *